US009444175B2

(12) United States Patent
Chen

(10) Patent No.: US 9,444,175 B2
(45) Date of Patent: Sep. 13, 2016

(54) SOCKET CONNECTOR

(71) Applicant: Liang Light Chen, Los Gatos, CA (US)

(72) Inventor: Liang Light Chen, Los Gatos, CA (US)

( * ) Notice: Subject to any disclaimer, the term of this patent is extended or adjusted under 35 U.S.C. 154(b) by 98 days.

(21) Appl. No.: 14/555,238

(22) Filed: Nov. 26, 2014

(65) Prior Publication Data

US 2016/0149331 A1 May 26, 2016

(51) Int. Cl.

| | |
|---|---|
| ***H01R 3/00*** | (2006.01) |
| ***H01R 13/46*** | (2006.01) |
| ***H01R 13/506*** | (2006.01) |
| *H01R 25/00* | (2006.01) |
| *H01R 103/00* | (2006.01) |
| *H01R 24/78* | (2011.01) |

(52) U.S. Cl.

CPC ..... *H01R 13/465* (2013.01); *H01R 13/506* (2013.01); *H01R 24/78* (2013.01); *H01R 25/006* (2013.01); *H01R 2103/00* (2013.01)

(58) Field of Classification Search

USPC ..... 439/488, 491, 652, 315

See application file for complete search history.

(56) References Cited

U.S. PATENT DOCUMENTS

| | | | | |
|---|---|---|---|---|
| 5,795,186 | A * | 8/1998 | Tulley | H02B 1/048 439/491 |
| 6,283,787 | B1 * | 9/2001 | Chou | H01R 13/465 439/488 |
| 6,830,477 | B2 * | 12/2004 | Vander Vorste | H01R 13/743 439/214 |
| 8,038,454 | B2 * | 10/2011 | Jiang | H01R 25/003 439/106 |
| 8,439,697 | B2 * | 5/2013 | Vass | H01R 13/6395 439/270 |
| 8,882,536 | B2 * | 11/2014 | Utz | H01R 23/6866 439/535 |
| 2014/0126116 | A1 * | 5/2014 | Irons | H05K 7/1492 361/622 |
| 2015/0214683 | A1 * | 7/2015 | Irons | H05K 7/1492 439/652 |
| 2015/0222063 | A1 * | 8/2015 | Irons | H01R 25/006 439/488 |

OTHER PUBLICATIONS

Tripplite; PDU12IEC product specification; http://www.tripplite.com/products/model-print/mid/2459#/, Downloaded Nov. 26, 2014.

APC by Schneider Electric;Rack PDU, Part No. AP9571A-UL 817, http://www.apc.com/products/resource/include/techspec_index.cfm?base_sku=AP9571A&tab; Nov. 26, 2014.

Centric Basic CDU; Server Technology; http://cdn1.servertech.com/assets/documents/documents/975/original/ServertechDS_BasicCDU_Oct13.pdf?1382651804; Oct. 2012.

IEC Appliance Outlet; Schurter Electronic Components; Fhttp://www.schurterinc.com/var/schurter/storage/ilcatalogue/files/document/datasheet/en/pdf/typ_6600-4.pdf; Nov. 26, 2014.

Qualtek Electronics Corp. Part # 716W-X2/03; http://www.qualtekusa.com/Catalog/AC_Receptacles/pdfs/716wx203.pdf; Mar. 10, 2004.

http://www.bulgin.co.uk/PDFs/Cat83_sections/In-Outlets-2010.pdf#page=18.

Bulgin IEC Connectors; EN60 320-2-2 Standard Sheet F Class I; p. 90; http://www.bulgin.co.uk/PDFs/Cat83_sections/In-Outlets-2010.pdf; Downloaded Nov. 26, 2014.

* cited by examiner

*Primary Examiner* — Tho D Ta

(74) *Attorney, Agent, or Firm* — Douglas L. Weller

(57) ABSTRACT

A socket connector has a core. The core has a base located at a first end of the core and has a plurality of orifices opening at a second end of the core. Each socket contact in a plurality of socket connectors includes a socket contact lead. Each of the socket contacts in the plurality of socket connectors is located in an orifice in the plurality of orifices so that the socket contact lead of each socket contact lead extends through the base and outside the socket connector. A core cap is affixed to the core so that the core cap covers the plurality of orifices.

19 Claims, 6 Drawing Sheets

SOCKET CONNECTOR

BACKGROUND

Socket connectors, connected to power, serve as power conduits for appliances. Socket connectors can provide either Alternating Current (AC) or Direct Current (DC). For example, C13 socket connectors (female) and C14 appliance inlet (males) are frequently used with computer and computer related peripherals.

DESCRIPTION OF THE EMBODIMENT

Figure 1:
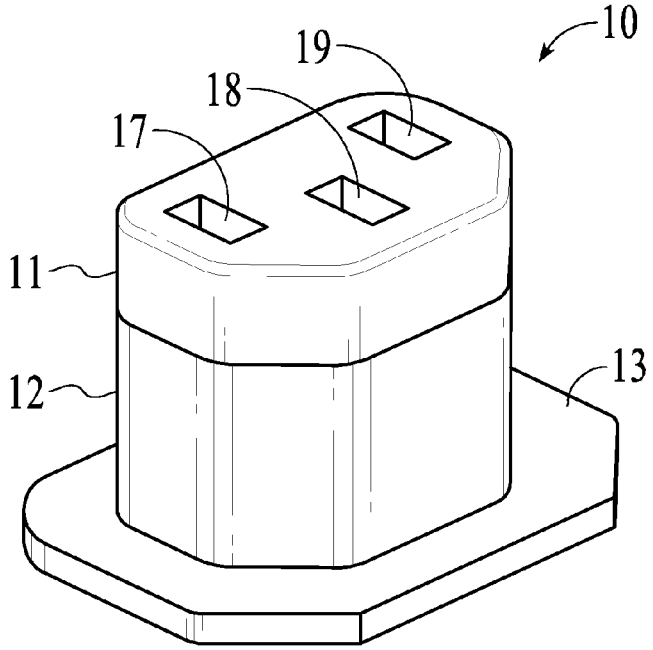
FIG. 1 shows an assembled socket connector in accordance with an embodiment.

FIG. 1 shows a socket connector 10 having a base 13, a core 12 and a core cap 11. Connector plug leads from a matching connector plug are inserted into an opening 17, an opening 18 and an opening 19 of core cap 11. While base 13 is shown extending out horizontally beyond core 12, this is an optional feature.

For example, socket connector 10 is a C13 connector as specified by standards of International Electrotechnical Commission (IEC) 60320. Alternatively, socket connector is another type of socket connector compatible with another IEC standard or compatible with a standard from another standards organization.

Cap 11 can be color coded to indicate information about the power supplied by the socket connector. For example, the indicated information can be phase information of a power signal provided by the socket connector. Other indication can be indicated as well. For example, the indicated information can be a branch indication indicating whether a power strip has more than one branch circuits. For example, the indicated information can be provide information pertaining to an intelligent power strip that has a different switching or measure function for each outlet, or that has a power-on sequence order for the outlets of the intelligent power strip.

Figure 2:
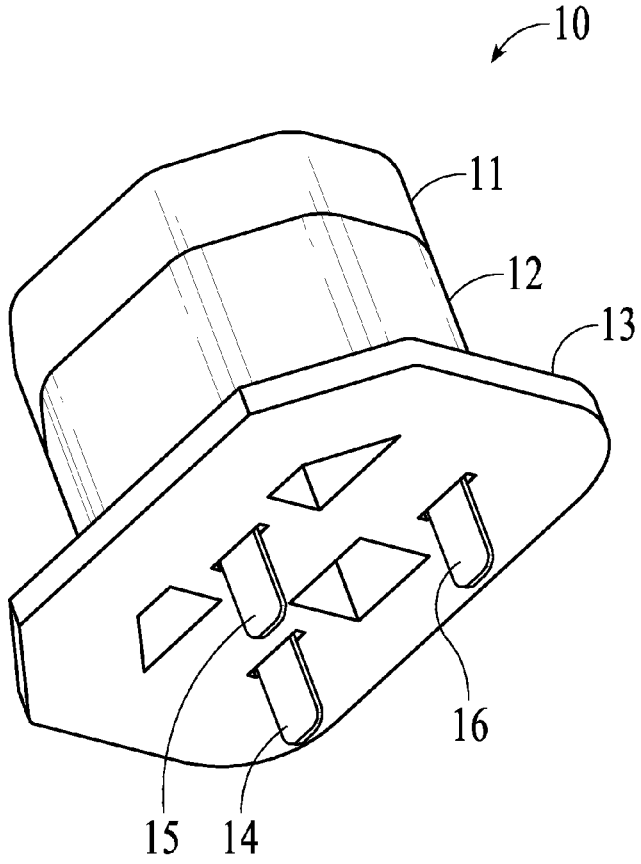
FIG. 2 shows another view of the assembled socket connector shown in FIG. 1 in accordance with an embodiment.

FIG. 2 shows another view of socket connector 10. A socket contact lead 14, a socket contact lead 15 and a socket contact lead 16 are available for connection to wires or a printed circuit board that provides power to socket connector 10.

Figure 3:
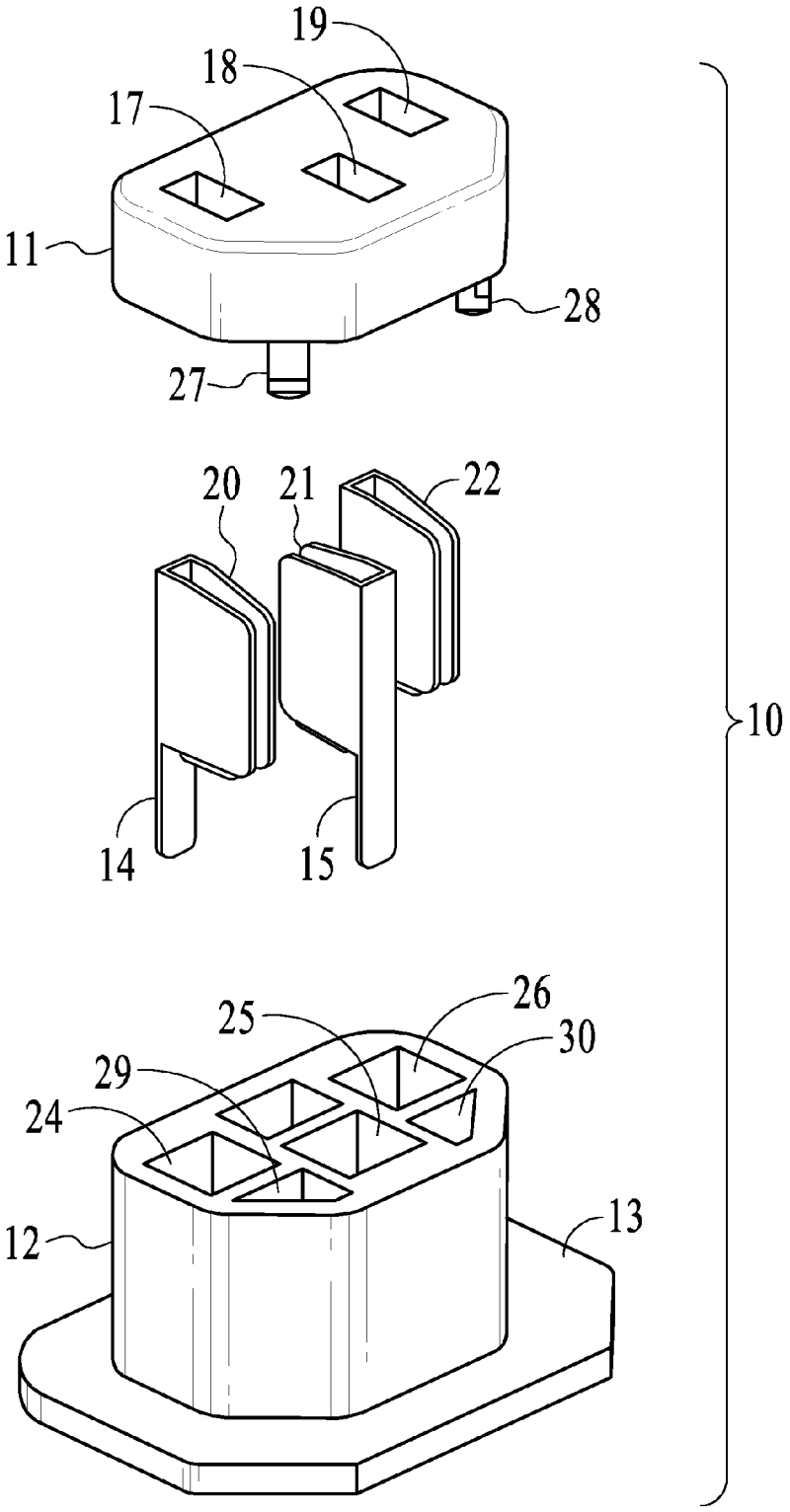
FIG. 3 shows an exploded view of the socket connector shown in FIG. 1 in accordance with an embodiment

FIG. 3 shows an exploded view of socket connector 10. A connection tab 27 and a connection tab 28 are respectively inserted into a tab clamp opening 29 and a tab clamp opening 30 to secure core cap 11 to core 12. Socket contact lead 14 is shown to be part of a socket contact 20. Socket contact lead 15 is shown to be part of a socket contact 21. Socket contact lead 16 is shown integrated with a socket contact 22. During assembly, socket contact 20 is placed in an orifice 24 so that socket contact lead 14 extends below base 13. Socket contact 21 is placed in an orifice 25 so that socket contact lead 15 extends below base 13. Socket contact 22 is placed in an orifice 26 so that socket contact lead 16 extends below base 13.

When socket connector 10 is fully assembled, a connector plug lead placed within opening 17 is held in place by friction with socket contact 20. Electrical contact between the inserted connector plug lead and socket contact lead 14 is established through socket contact 20. Likewise, a connector plug lead placed within opening 18 is held in place by friction with socket contact 21. Electrical contact between the inserted connector plug lead and socket contact lead 15 is established through socket contact 21. A connector plug lead placed within opening 19 is held in place by friction with socket contact 22. Electrical contact between the inserted connector plug lead and socket contact lead 16 is established through socket contact 22. For example, core cap 11 holds socket contact 20, socket contact 21 and socket contact 22 in place within core 12.

While the embodiment in FIG. 1, FIG. 2 and FIG. 3 includes three orifices for receiving three socket contacts, different numbers of socket contacts can be used. For example, a core with two orifices for receiving two socket contacts can be used. Alternatively, a core with four or more orifices for receiving four or more socket contacts can be used. Likewise, while the embodiment in FIG. 3 includes two tab clamp openings for receiving two connection tabs, different numbers of connection tabs can be used. For example, a core with a single tab clamp opening for receiving a single connection tab can be used. Alternatively, a core with two or more tab clamp opening for receiving two or more connection tabs can be used. Also, in various embodiments, more that one connection tab can be inserted in a single tab clamp opening.

Figure 4:
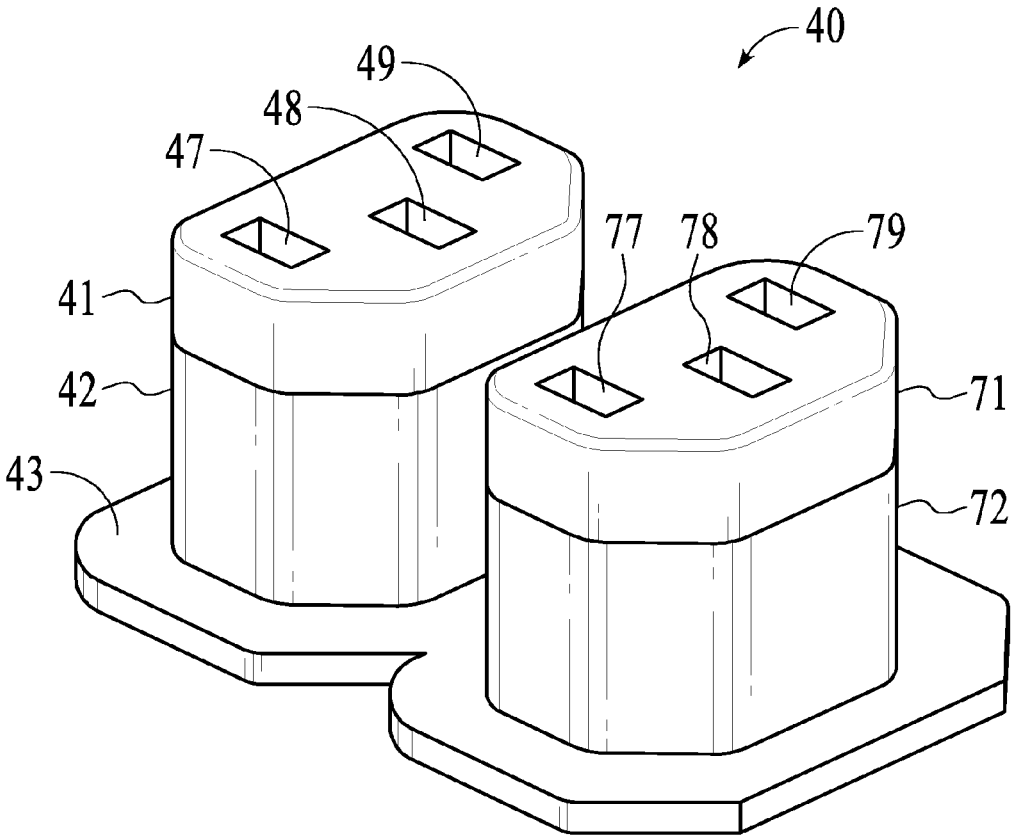
FIG. 4 shows an assembled multiple module socket connector in accordance with an embodiment.

Two or more socket connector modules can be connected at their base to form a multiple module socket connectors. For example, FIG. 4 shows a multiple module socket connector 40. A first power module has a common base 43, a core 42 and a core cap 41. Connector plug leads from a matching connector plug are inserted into an opening 47, an opening 48 and an opening 49 of core cap 41. A second power module has common base 73, a core 72 and a core cap 71. Connector plug leads from a matching connector plug are inserted into an opening 77, an opening 78 and an opening 79 of core cap 71. While in FIG. 4, core 42 and core 72 are shown only connected at common base 43, other points or areas of connection can also exist.

Figure 5:
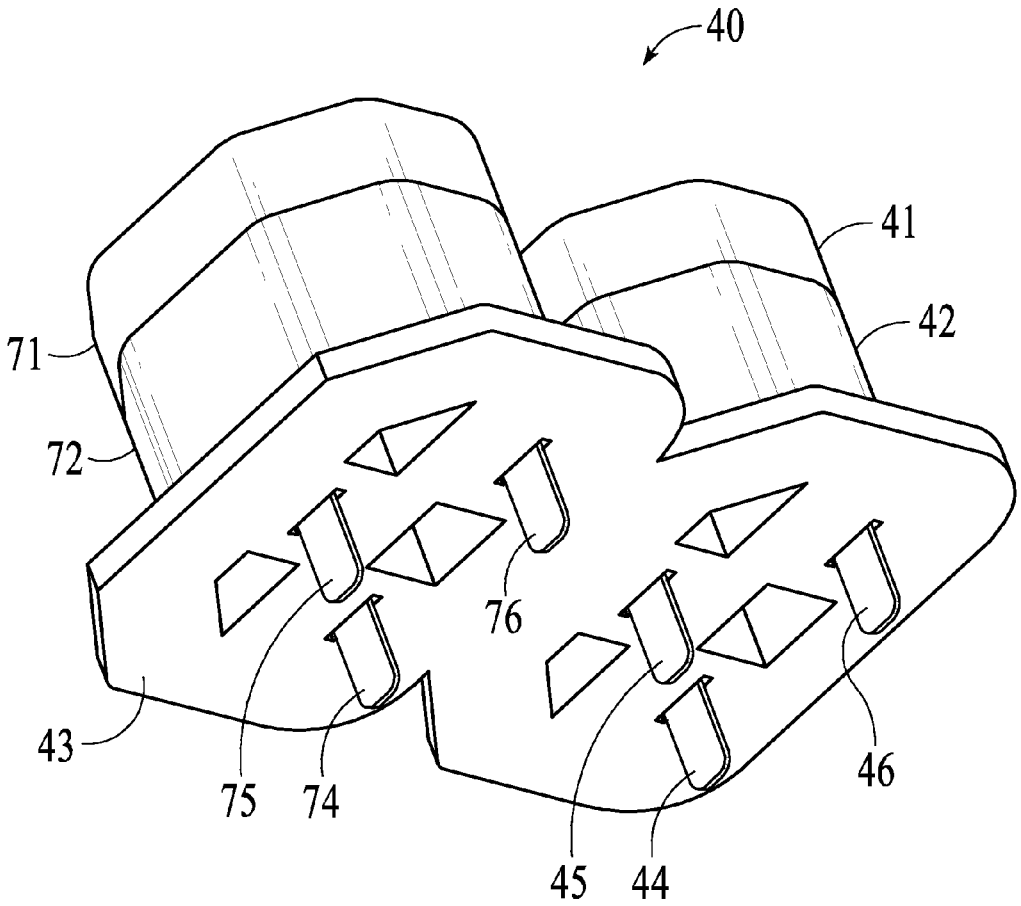
FIG. 5 shows another view of the assembled multiple module socket connector shown in FIG. 4 in accordance with an embodiment.

FIG. 5 shows another view of multiple module socket connector 40. A socket contact lead 44, a socket contact lead 45 and a socket contact lead 45 are available for connection to wires or a printed circuit board that provides power to multiple module socket connector 40. Likewise, a socket contact lead 74, a socket contact lead 75 and a socket contact lead 75 are available for connection to wires or a printed circuit board that provides power to multiple module socket connector 40.

Figure 6:
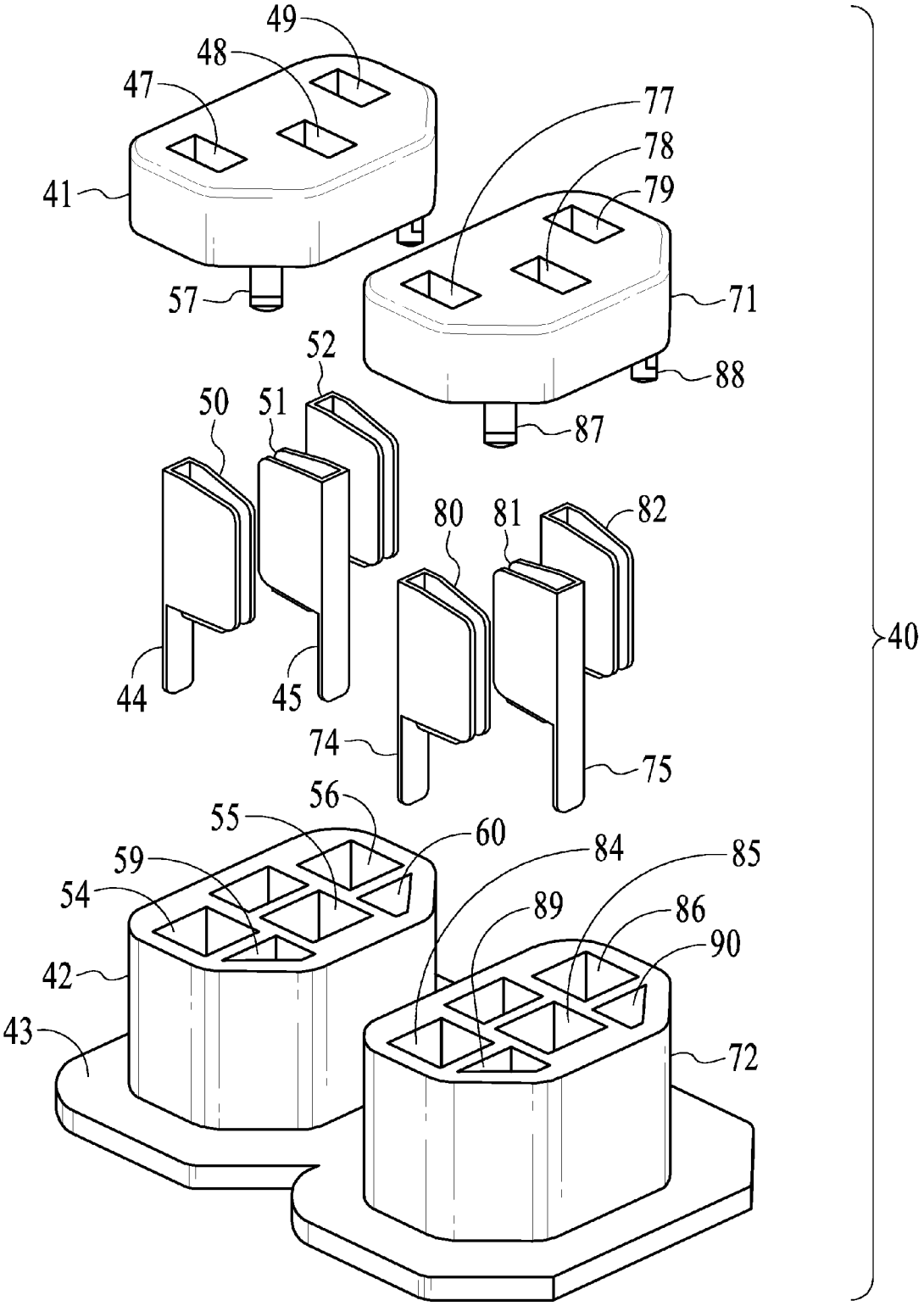
FIG. 6 shows an exploded view of the multiple module socket connector shown in FIG. 4 in accordance with an embodiment.

FIG. 6 shows an exploded view of multiple module socket connector 40. A connection tab 57 and a connection tab 58 are respectively inserted into a tab clamp opening 59 and a tab clamp opening 60 to secure core cap 41 to core 42. Socket contact lead 44 is shown to be part of a socket contact 50. Socket contact lead 45 is shown to be part of a socket contact 51. Socket contact lead 46 is shown to be part of a socket contact 52. During assembly, socket contact 50 is placed in an orifice 54 so that socket contact lead 44 extends below common base 43. Socket contact 51 is placed in an orifice 55 so that socket contact lead 45 extends below common base 43. Socket contact 52 is placed in an orifice 56 so that socket contact lead 46 extends below common base 43.

When multiple module socket connector 40 is fully assembled, a connector plug lead placed within opening 47 is held in place by friction with socket contact 50. Electrical contact between the inserted connector plug lead and socket contact lead 44 is established through socket contact 50. Likewise a connector plug lead placed within opening 48 is held in place by friction with socket contact 51. Electrical contact between the inserted connector plug lead and socket contact lead 45 is established through socket contact 51. A connector plug lead placed within opening 49 is held in place by friction with socket contact 52. Electrical contact between the inserted connector plug lead and socket contact lead 46 is established through socket contact 52. For example, core cap 41 holds socket contact 50, socket contact 51 and socket contact 52 in place within core 42.

Likewise, connection tab 87 and a connection tab 88 are respectively inserted into a tab clamp opening 89 and a tab clamp opening 90 to secure core cap 71 to core 72. Socket contact lead 74 is shown to be part of a socket contact 80. Socket contact lead 75 is shown to be part of a socket contact 81. Socket contact lead 76 is shown to be part of a socket contact 82. During assembly, socket contact 80 is placed in an orifice 84 so that socket contact lead 74 extends below common base 73. Socket contact 81 is placed in an orifice 85 so that socket contact lead 75 extends below common base 73. Socket contact 82 is placed in an orifice 86 so that socket contact lead 76 extends below common base 73. For example, core cap 71 holds socket contact 80, socket contact 81 and socket contact 82 in place within core 72.

When multiple module socket connector 40 is fully assembled, a connector plug lead placed within opening 77 is held in place by friction with socket contact 80. Electrical contact between the inserted connector plug lead and socket contact lead 74 is established through socket contact 80. Likewise, a connector plug lead placed within opening 78 is held in place by friction with socket contact 81. Electrical contact between the inserted connector plug lead and socket contact lead 75 is established through socket contact 81. A connector plug lead placed within opening 79 is held in place by friction with socket contact 82. Electrical contact between the inserted connector plug lead and socket contact lead 76 is established through socket contact 82.

A single socket connector, a multiple module socket connector or any combination of single socket connectors and multiple module socket connectors can be assembled within housing useful for a particular application.

Figure 7:
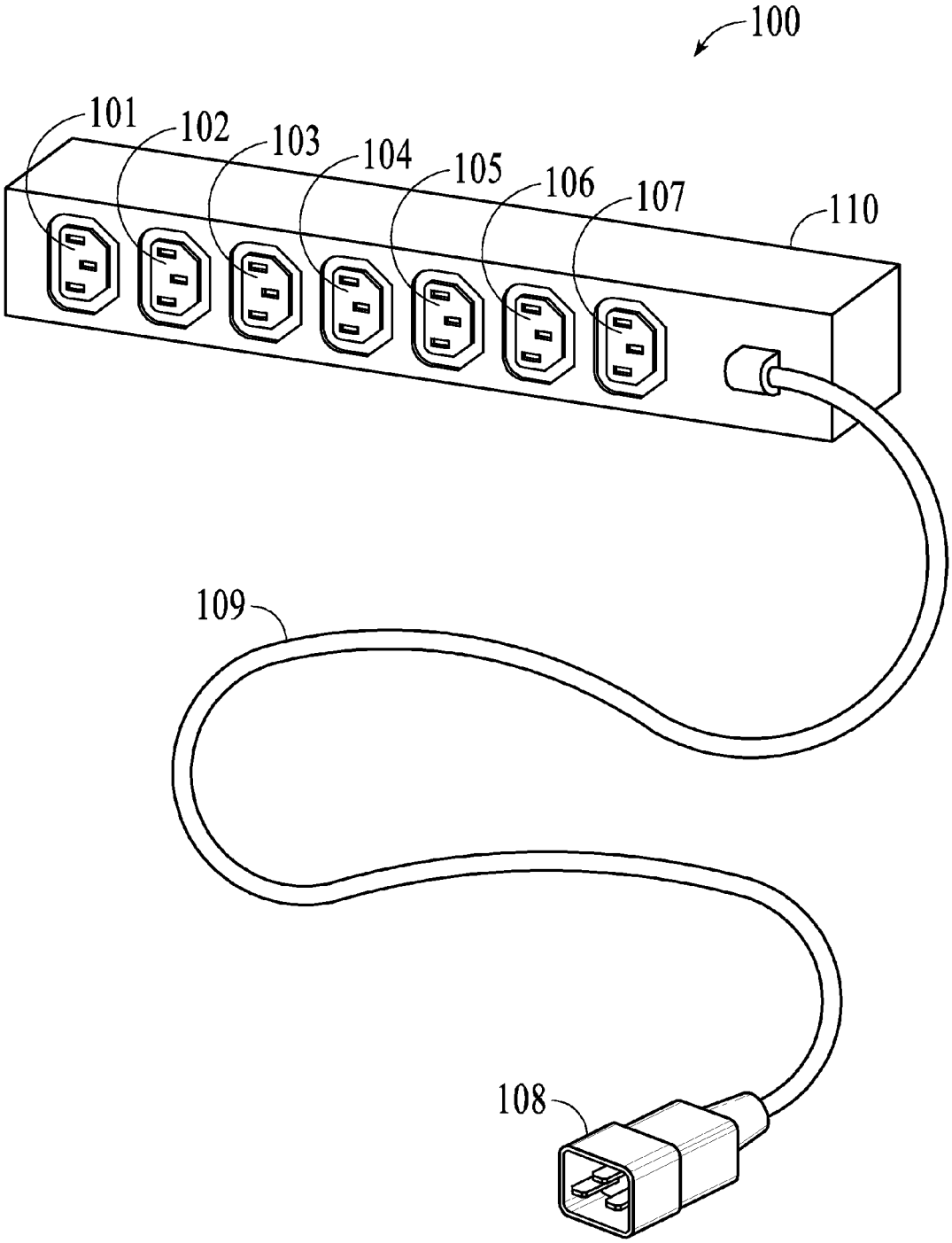
FIG. 7 shows housing for a multiple module socket connector in accordance with an embodiment.

For example, FIG. 7 shows a power strip 100 that includes housing 110 that houses a socket connector module 101, a socket connector module 102, a socket connector module 103, a socket connector module 104, a socket connector module 105, a socket connector module 106 and a socket connector module 107. Socket connector modules 101 through 107 can be implemented using any combination of single socket connectors and multiple module socket connectors. Power to power strip 100 is supplied through a power line 108 and a connector 108 when connector 108 is plugged into a power source.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A socket connector comprising:

a core, having a base located at a first end of the core and having a plurality of orifices opening at a second end of the core;

a plurality of socket contacts, wherein each socket contact in the plurality of socket contacts including a socket contact lead, and wherein each of the socket contacts in the plurality of socket contacts is located in an orifice in the plurality of orifices so that the socket contact lead of each socket contact lead extends through the base and outside the socket connector; and, a core cap that is attachable to the core so that before the core cap is attached to the core, the plurality of orifices is uncovered allowing the plurality of socket contacts to be loaded into the plurality of orifices, wherein when the core cap is affixed to the core, the core cap prevents removal of the plurality of socket contacts from the plurality of orifices.

2. A socket connector as in claim 1, wherein the socket connector is a C13 connector or a C19 connector as specified by standards of International Electrotechnical Commission (IEC) 60320.

3. A socket connector as in claim 1, wherein the core cap is color coded to indicate information about the power supplied by the socket connector.

4. A socket connector as in claim 3, wherein the information indicated by color of the core cap is one of the following:

phase information of a power signal provided by the socket connector;

a branch indication indicating whether a power strip has more than one branch circuits;

information pertaining to an intelligent power strip that has a different switching or measure function for each outlet of the intelligent power strip, or that has a power-on sequence order for outlets of the intelligent power strip.

5. A socket connector as in claim 1, wherein the base is a common base shared by a plurality of cores.

6. A socket connector as in claim 1, wherein the core cap includes a tab, the tab being inserted into a tab clamp opening of the core to clamp the core cap to the core.

7. A socket connector as in claim 1:

wherein the core cap includes a plurality of tabs;

wherein the core includes a plurality of tab clamp openings; and wherein each tab in the plurality of tabs is inserted into a tab clamp opening from the plurality of tab clamp openings so as to clamp the core cap to the core.

8. A socket connector as in claim 1 wherein the socket connector is enclosed in housing along with other socket connectors.

9. A multiple module socket connector comprising:

a common base; and, a plurality of cores that share the common base wherein for each core in the plurality of cores, the common base is located at a first end of the core and a plurality of orifices opening at a second end of the core, and wherein each core in the plurality of cores includes:

a plurality of socket contacts, wherein each socket contact in the plurality of socket contacts including a socket contact lead, and wherein each of the socket contacts in the plurality of socket contacts is located in an orifice in the plurality of orifices so that the socket contact lead of each socket contact extends through the base and outside the socket connector, and a core cap that is attachable to the core so that before the core cap is attached to the core, the plurality of orifices is uncovered allowing the plurality of socket contacts to be loaded into the plurality of orifices, wherein when the core cap is affixed to the core, the core cap prevents removal of the plurality of socket contacts from the plurality of orifices.

10. A multiple module socket connector as in claim 9, wherein each socket connector in the multiple module socket connectors is a C13 connector or a C19 connector as specified by standards of International Electrotechnical Commission (IEC) 60320.

11. A multiple module socket connector as in claim 9, wherein the core cap is color connected to indicate information about the power supplied by the socket connector.

12. A multiple module socket connector as in claim 11, wherein the information indicated by color of the core cap is one of the following:

phase information of a power signal provided by the socket connector;

a branch indication indicating whether the multiple module socket has more than one branch circuits;

information pertaining to different switching or measure function for each core of the multiple module socket, or pertaining to a power-on sequence order for cores of the multiple module socket.

13. A multiple module socket connector as in claim 9, wherein the core cap includes a tab, the tab being inserted into a tab clamp opening of the core to clamp the removable core cap to the core.

14. A multiple module socket connector as in claim 9:

wherein the core cap includes a plurality of tabs;

wherein each core in the plurality of cores includes a plurality of tab clamp openings; and wherein each tab in the plurality of tabs is inserted into a tab clamp opening from the plurality of tab clamp openings so as to clamp the core cap to the core.

15. A method for producing a socket connector comprising:

forming a core having a base located at a first end of the core and having a plurality of orifices opening at a second end of the core;

placing a plurality of socket contacts into the plurality of orifices, wherein each socket contact in the plurality of socket contacts includes a socket contact lead, and wherein each of the socket contacts in the plurality of socket contacts is placed so that the socket contact lead of each socket contact extends through the base and outside the socket connector; and, affixing a core cap to the core so that the core cap prevents removal of the plurality of socket contacts from the plurality of orifices.

16. A method as in claim 15, wherein the socket connector is a C13 connector or a C19 connector as specified by standards of International Electrotechnical Commission (IEC) 60320.

17. A method as in claim 15, additionally comprising:

coloring coding the core cap to indicate information about the power supplied by the socket connector.

18. A method as in claim 17, wherein the information indicated by the core cap color is one of the following:

phase information of a power signal provided by the socket connector;

a branch indication indicating whether a power strip has more than one branch circuits;

information pertaining to an intelligent power strip that has a different switching or measure function for each outlet of the intelligent power strip, or that has a power-on sequence order for outlets of the intelligent power strip.

19. A method as in claim 17 additionally comprising:

enclosing the socket connector in housing along with other socket connectors.

* * * * *